United States Patent [19]

Carlomagno et al.

[11] 3,957,258

[45] May 18, 1976

[54] NOZZLES OF THE LANCE HEADS FOR BLOWING OXYGEN FROM ABOVE IN THE REFINING PROCESSES

[75] Inventors: Giovanni Maria Carlomagno, Neaples; Antonio Cecere, Taranto; Bruno Costa, Neaples; Nicola Muni, Taranto; Luigi Napolitano, Neaples, all of Italy

[73] Assignee: Italsider S.p.A., Genoa, Italy

[22] Filed: Aug. 5, 1974

[21] Appl. No.: 494,436

[30] Foreign Application Priority Data

Aug. 8, 1973 Italy ..... 12791/73

[52] U.S. Cl. ..... 266/225

[51] Int. Cl.[2] ..... C21C 7/00

[58] Field of Search ..... 239/132.3, 132.5, 299, 239/601; 266/34 L, 34 LM

[56] References Cited

UNITED STATES PATENTS

| | | | |
|---|---|---|---|
| 2,583,726 | 1/1952 | Chalom | 239/601 X |
| 3,130,920 | 4/1964 | Devillard | 239/601 |
| 3,430,939 | 3/1969 | Berry | 266/34 L |
| 3,550,864 | 12/1970 | East | 239/601 |
| 3,559,974 | 2/1971 | Berry | 266/34 L |
| 3,567,202 | 3/1971 | Mercatoris et al. | 266/34 L |

*Primary Examiner*—Gerald A. Dost

*Attorney, Agent, or Firm*—Nolte and Nolte

[57] ABSTRACT

The object of the present invention consists of improved nozzles for the lance heads for blowing oxygen from above, in the refining processes.

4 Claims, 3 Drawing Figures

1
2
3
4
5
6
7
D
0,1D
0,1D
0,1D
0,1D
B 1
2
3
4
5
6
7
D
0,1D
0,1D
0,1D
A

NOZZLES OF THE LANCE HEADS FOR BLOWING OXYGEN FROM ABOVE IN THE REFINING PROCESSES

BACKGROUND OF THE INVENTION

The nozzles of the lance heads for blowing oxygen have the task of providing the metal bath with the necessary amount of oxygen for refining cast-iron. The oxygen is to be conveyed to the bath with suitable quantities and manners; in fact, the metallurgical results of the conversion depend on e.g. the number and shape of the nozzles through which are formed the jets acting on the metal bath and interacting therewith. It is therefore necessary a careful fluid-dynamic study on the shape of the nozzles generating said oxygen jets.

OBJECT OF THE INVENTION

The object of the invention relates to an improvement in designing the nozzles for the lance heads generating supersonic jets, and above all considers the functions said oxygen jets must perform in their interaction with said metal bath. Said functions tend mainly to reach the following metallurgical results: a high value of the conversion yield for the iron, a good distribution of the oxygen between slag and bath, a high value of the utilization coefficient for the oxygen, the absence of the phenomena of the metallurgical and slag projections, a possibility of repeating the results, a stability of said results even in presence of a variation in the geometrical conditions of the converter and of a wear in the end portion of said nozzles.

SUMMARY OF THE INVENTION

In nozzles of the type comprising a zone converging upstream of the throat section and a zone diverging downstream thereof, said diverging zone has a substantially concave shape connecting to the throat zone having a substantially convex outline, instead of the traditional frusto-conical shape.

The outline of the diverging concave zone of the nozzle consists of a single branch of a curve, parabola, circle arc and the like, with its concavity facing the nozzle axis.

The outline of said diverging zone consists of more branches of curves suitably connected to one another by connections, angle points and possibly straight line segments.

The tangent to the nozzle outline, correspondingly to the end of the diverging zone, is parallel to the nozzle axis.

BRIEF DESCRIPTION OF THE DRAWINGS

In order that the invention may be clearly understood, it will now be described, by way of example, with reference to the accompanying drawings wherein.

DESCRIPTION OF THE PREFERRED EMBODIMENTS

Figure 2:
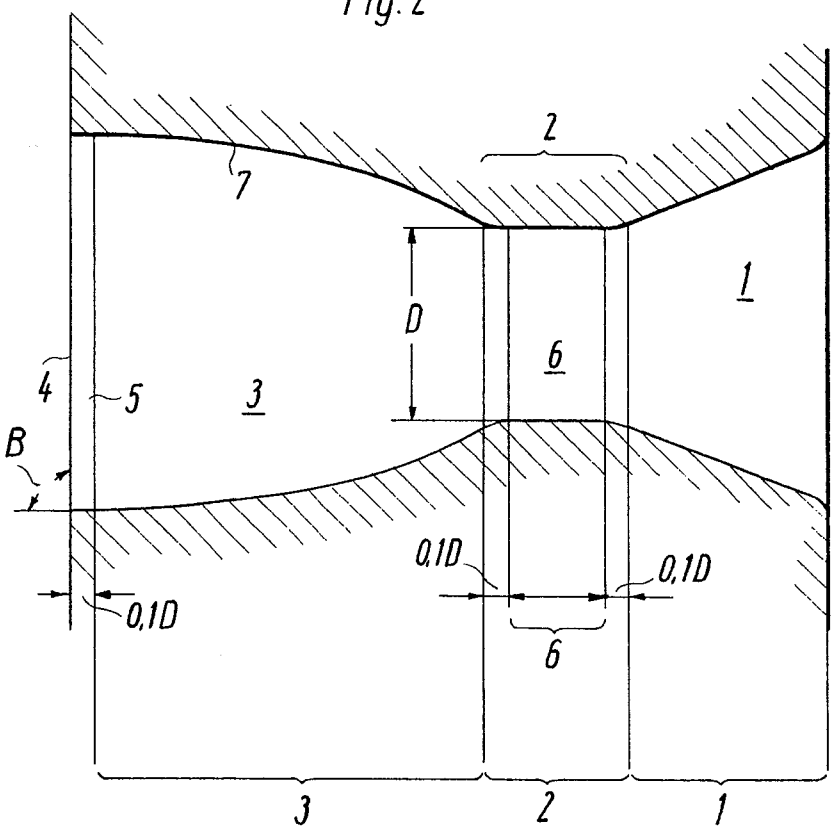
FIGS. 1 and 2 show the axial section of two nozzles according to the invention.
Figure 1:
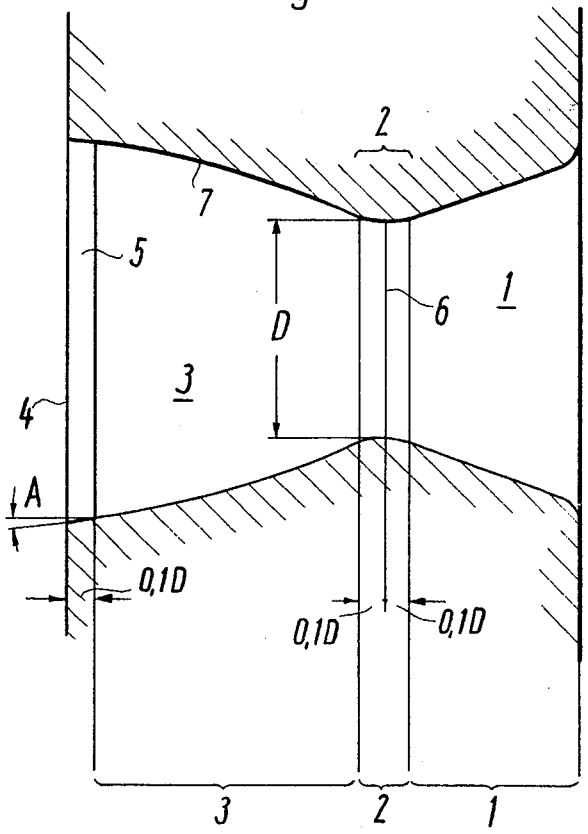

The following are the characteristic zones, axxially symmetric and not, of a nozzle generating a fluid jet: section or converging zone 1 which is the first portion of the nozzle projecting from the beginning of the nozzle to the throat zone; throat portion or zone 2 which is the portion close to the section of throat 6 of the nozzle (section of the fluid passage with the lowest area), and which projects both upstream and downstream of the latter for a distance of a tenth of the hydraulic diameter D of the section of said throat; the nozzle throat is provided with a cylindrical surface, the length of said throat zone comprises the length of said cylindrical surface plus the portions 0.1D upstream and downstream (FIG. 2); diverging portion or zone 3 which is the remaining part of the nozzle extending from the throat zone 2 to the nozzle end (outlet section 4 of said nozzle) excepting at the most a portion 5 which form the outlet section 4 of said nozzle extends upstream for a tenth of said hydraulic diameter D of said throat section.

As axially symmetric nozzle, outline of the longitudinal section or shortly nozzle outline, the curve 7 is defined which is obtained by intersecting the inner surface of the nozzle (the surface in contact with the fluid passing through the nozzle) with a semi-plane originated on the nozzle symmetry axis.

Having reported the above definitions of general kind, the features of the nozzle according to the invention are pointed out herebelow.

In both figure, the diverging zone 3 of the nozzle does not have the traditional frusto-conical shape, but has a substantially concave shape after a convex starting portion, within the throat zone, where the expansion zone of the fluid current is concentrated. Said outline 7 of the nozzle diverging zone may be formed by the branch of a single curve, parabola, circle arc and the like, or by more portions of different curves connected to each other, or by angle points or straight line portions which originate frusto-conical portions.

Anyhow, said outline 7 so obtained will, in its whole, comprise after said convex zone correspondingly to said throat zone, a concave shape, i.e. suitable to accompany the expanding jet by limiting the radial components of the speed thereof at the nozzle outlet.

Correspondingly to the end of the nozzle, or better to the diverging portion thereof, the tangent to said outline 7 may be parallel to the nozzle axis, as shown in FIG. 2 where angle B is equal to 90°, or diverging outwards for a suitably selected angle A. In this case B will be larger than 90°.

Figure 3:
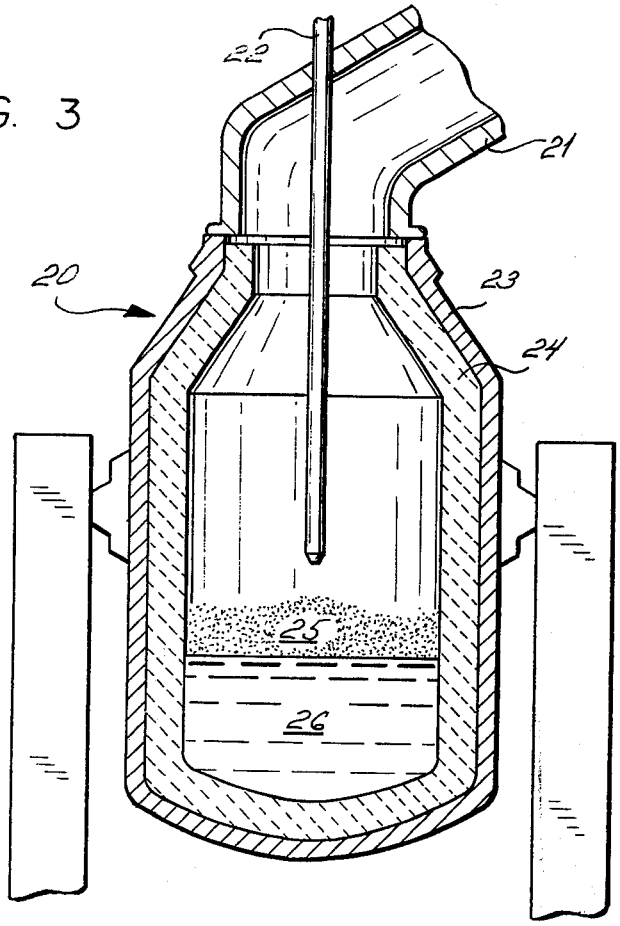
FIG. 3 is an axial section of a lance including the nozzle of this invention in combination with a steel making furnace including a vessel containing a bath including molten iron and slag.

In actual practice, the nozzle is incorporated in a lance 22 extending through the dust collecting hood 21 of a steel making furnace vessel 20 having a steel shell 23 and a refractory lining 24 and containing an iron bath 26 with slag 25 floating thereon (FIG. 3).

The laboratory and metallurgical tests proved that the traditional De Laval nozzles were not sufficient to provide jets with a good interaction with the metal bath in the conditions concerned. Further, their operation was particularly sensitive to the wear condition of their end portion in that moment.

On the contrary, the nozzles of the type suggested allowed: a better conversion of the inner energy of oxygen into kinetic energy; a reduction of the dissipating phenomena; a decrease in the speed radial components in the outlet section; better interaction features of the jets with the metal bath; a lower dependability of the jets features on the wear of the nozzle end portion.

Said features, together with a suitable selection of the nozzle number and the oxygen feeding pressures, led to absolutely satisfying metallurgical results.

It is to be understood that the invention is not limited to the examples shown. It is intended to cover all modifications and equivalents within the scope of the appended claims.

What we claim is:

1. In the combination of a steel making furnace including a vessel for containing a bath including molten iron and slag and a lance for conveying oxygen to the bath, the lance including a nozzle for causing the oxygen to eject from the lance as a jet, the nozzle having for the conveyance of the oxygen a passage defined by walls surrounding the passage and having a first zone defined by convergence of the walls in the direction in which the oxygen is to travel through the nozzle, a second zone joined with the first zone and defined by formation by the walls of a throat in the nozzle, the throat including the smallest cross sectional area of the nozzle passage, and a third zone joined with the second zone and defined by divergence of the walls in the direction in which the oxygen is to travel through the nozzle, the improvement in which in the third zone the walls are concave, at the juncture of the second zone with the third zone the walls are convex, the concave portion of the walls curvilinearly merges with the convex portion of the walls so that no angle is formed, the downstream end of the throat is defined by the boundary between the convex portion of the walls and the concave portion of the walls and the downstream end of the throat is spaced from the downstream extreme of the smallest cross section of the throat a distance equal to one-tenth the diameter of the smallest cross section.

2. In the combination according to claim 1, in the improvement in which a tangent taken at the downstream end of the axial cross section of the portion of the walls defining the third zone is parallel to the nozzle axis.

3. In the combination according to claim 1, in the improvement in which a tangent taken at the downstream end of the axial cross section of the portion of the walls defining the third zone diverges from the nozzle axis in the direction in which the oxygen is to travel through the nozzle.

4. In the combination according to claim 1, in the improvement in which the walls in the first zone are frustroconical, at the juncture of the first zone with the second zone the walls are convex, the upstream end of the throat is defined by the boundary between the frustroconical portion of the walls and the convex walls at the juncture of the first and second zones and the upstream end of the throat is spaced from the upstream extreme of the smallest cross section of the throat a distance equal to one-tenth the diameter of the smallest cross-section.

* * * * *